US008713822B1

(12) United States Patent
Shipp

(10) Patent No.: US 8,713,822 B1
(45) Date of Patent: May 6, 2014

(54) PATH LIGHTING SYSTEM INTEGRATED WITH A SLIPPER

(71) Applicant: Evelyn R. Shipp, Spring Hill, FL (US)

(72) Inventor: Evelyn R. Shipp, Spring Hill, FL (US)

( * ) Notice: Subject to any disclaimer, the term of this patent is extended or adjusted under 35 U.S.C. 154(b) by 0 days.

(21) Appl. No.: 13/938,841

(22) Filed: Jul. 10, 2013

(51) Int. Cl.
*A43B 23/00* (2006.01)

(52) U.S. Cl.
USPC ..... 36/137; 362/103

(58) Field of Classification Search
USPC ..... 36/137; 362/103
See application file for complete search history.

(56) References Cited

U.S. PATENT DOCUMENTS

| | | | | |
|---|---|---|---|---|
| 3,564,232 | A | 2/1971 | Ellerbe | |
| 4,324,054 | A | 4/1982 | Rovinsky | |
| D332,687 | S | 1/1993 | Altman et al. | |
| 5,237,760 | A | 8/1993 | Altman et al. | |
| 5,438,488 | A * | 8/1995 | Dion | 362/103 |
| 5,821,858 | A | 10/1998 | Stone | |
| 6,293,032 | B1 | 9/2001 | Waits | |
| 7,497,037 | B2 | 3/2009 | Vick et al. | |
| 2002/0109981 | A1 | 8/2002 | Amici | |
| 2004/0098884 | A1 * | 5/2004 | Swan | 36/137 |
| 2007/0144040 | A1 | 6/2007 | Chen | |
| 2010/0170115 | A1 * | 7/2010 | Smith, III | 36/137 |
| 2011/0146109 | A1 | 6/2011 | Martinez et al. | |

FOREIGN PATENT DOCUMENTS

| | | | | |
|---|---|---|---|---|
| FR | 2643794 | A1 * | 9/1990 | A43B 3/10 |

* cited by examiner

*Primary Examiner* — Ted Kavanaugh

(57) ABSTRACT

The present invention features a path lighting system integrated with a slipper for wearing a foot of a user. The system features a slipper. A slipper sole is located on a slipper sole plane. The system features a rechargeable power supply located in the slipper sole close to a slipper anterior end. A charging port is located on a slipper sole side edge. The system features a power switch. The system features a light located on a slipper top close to the slipper anterior end. The light is located on a light plane and projects a light beam on the light plane. The light plane is parallel to the slipper sole plane. The light is located in a light housing that is integrated into and contiguous with the slipper top.

5 Claims, 3 Drawing Sheets

PATH LIGHTING SYSTEM INTEGRATED WITH A SLIPPER

FIELD OF THE INVENTION

The present invention relates to lighted shoes.

BACKGROUND OF THE INVENTION

Walking in the dark can be scary and dangerous for children and adults alike. Sometimes, however, it is necessary to walk in an environment where there is no lighting present. The present invention features a path lighting system integrated with a slipper for wearing on a foot of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a path lighting system integrated with a slipper for wearing on a foot of a user. In some embodiments, the system comprises a slipper. In some embodiments, a slipper top close to a slipper anterior end is designed to enclose a plurality of toes of a user. In some embodiments, a slipper sole is located on a slipper sole plane.

In some embodiments, the system comprises a power supply. In some embodiments, the power supply is rechargeable. In some embodiments, the power supply is located in the slipper sole close to the slipper anterior end. In some embodiments, the power supply is designed to be located close to a ball of a foot of the user. In some embodiments, a charging part is located on a slipper sole side edge. In some embodiments, the charging port is operatively connected to the power supply.

In some embodiments, the system comprises power switch operatively connected to the power supply.

In some embodiments, the system comprises a light. In some embodiments, the light is located on the slipper top close to the slipper anterior end. In some embodiments, the light is located on a light plane. In some embodiments, the light projects a light beam on the light plane. In some embodiments, the light plane is parallel to a slipper sole plane. In some embodiments, the light is located in a light housing. In some embodiments, the light housing is integrated into and contiguous with the slipper top.

DESCRIPTION OF PREFERRED EMBODIMENTS

Figure 1:
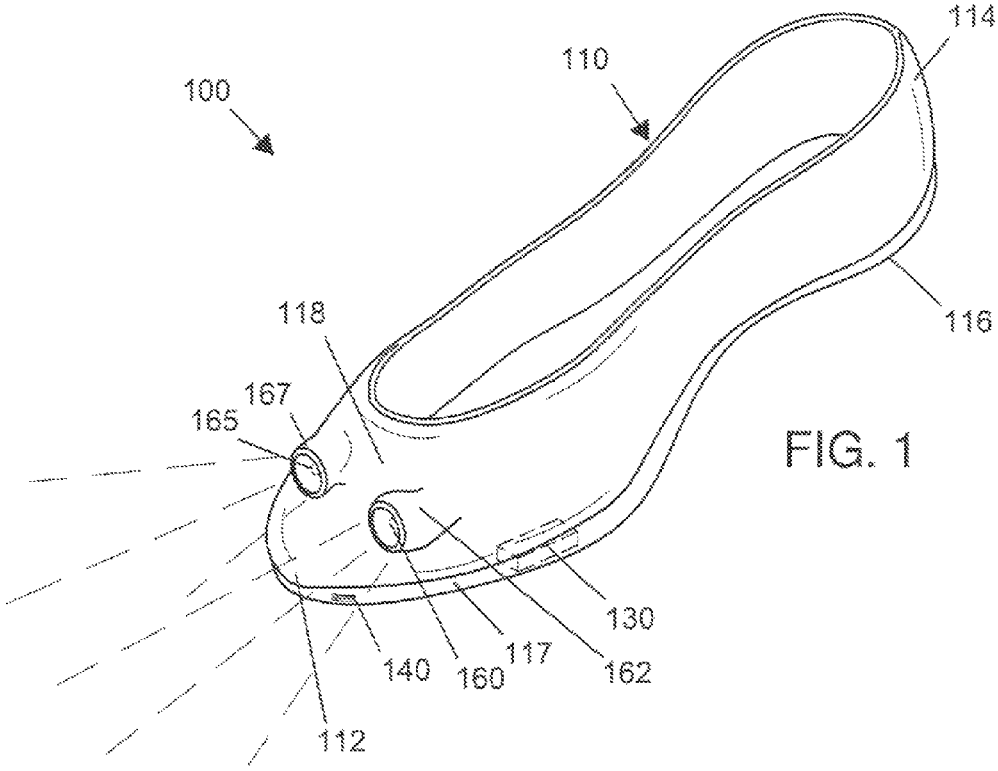
FIG. 1 shows a perspective view of the present invention.
Figure 2:
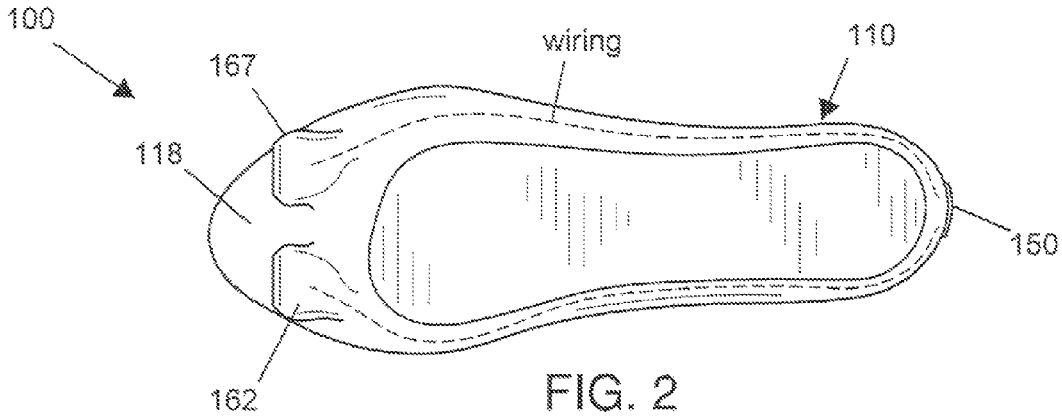
FIG. 2 shows a top view of the present invention.
Figure 3:
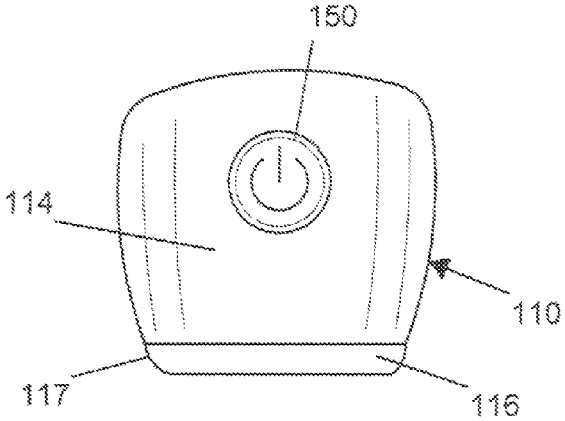
FIG. 3 shows a rear view of the present invention.
Figure 4:
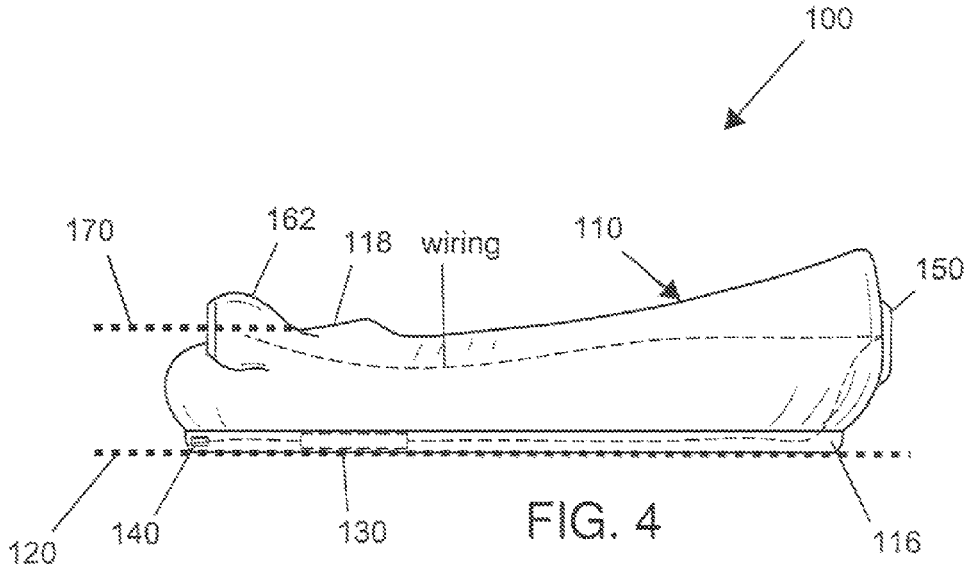
FIG. 4 shows a side view of the present invention.
Figure 5:
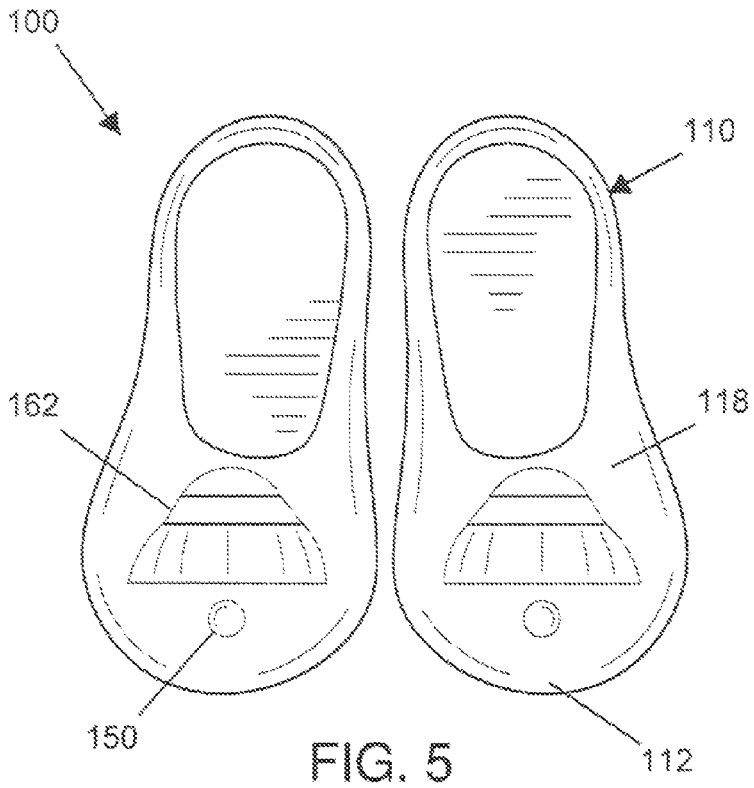
FIG. 5 shows a top view of an alternate embodiment of the present invention.
Figure 6:
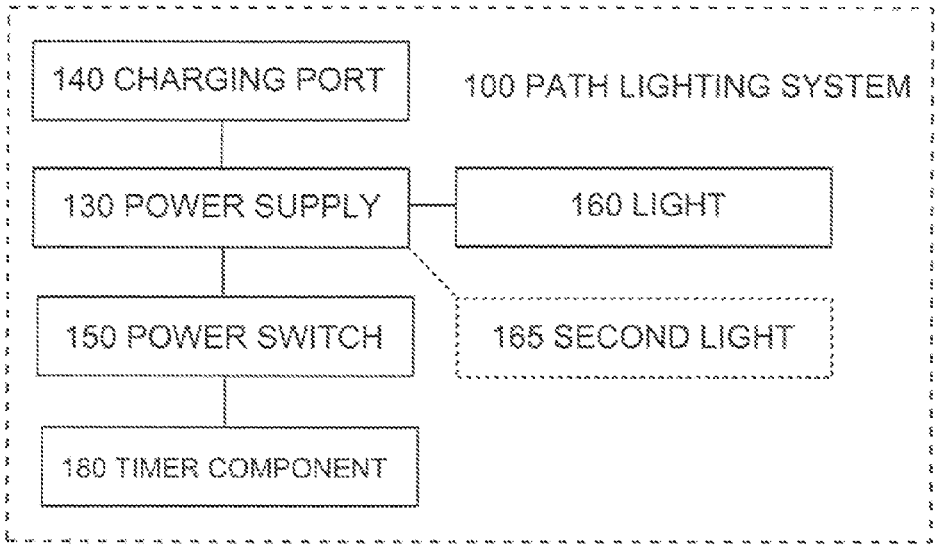
FIG. 6 shows a schematic view of the present invention.

Following is a list of elements corresponding to a particular element referred to herein:

100 Path lighting system
110 Slipper
112 Slipper anterior end
114 Slipper posterior end
116 Slipper sole
117 Slipper sole side edge
118 Slipper top
120 Slipper sole plane
130 Power supply
140 Charging port
150 Power switch
160 Light
162 Light housing
165 Second light
167 Second light housing
170 Light plane
180 Timer component Referring now to FIG. 1-6, the present invention features a path lighting system (100) integrated with a slipper (110) for wearing on a foot of a user. In some embodiments, the system (100) comprises a slipper (110) having a slipper anterior end (112), a slipper posterior end (114), a slipper sole (116), a slipper side, and a slipper top (118). In some embodiments, the slipper top (118) close to the slipper anterior end (112) is designed to enclose a plurality of toes of a user. In some embodiments, the slipper sole (116) is located on a slipper sole plane (120). In some embodiments, the slipper (110) is a house slipper. In some embodiments, the slipper (110) is any type of shoe or boot with a top surface at the front that encloses the toes either fully or partially.

In some embodiments, the system (100) comprises a power supply (130). In some embodiments, the power supply (130) is rechargeable. In some embodiments, the power supply (130) is located in the slipper sole (116) close to the slipper anterior end (112). In some embodiments, the power supply (130) is designed to be located close to a ball of a foot of the user. In some embodiments, a charging port (140) is located on a slipper sole side edge (117). In some embodiments, the charging port (140) is operatively connected to the power supply (130).

In some embodiments, the system (100) comprises a power switch (150) operatively connected to the power supply (130). In some embodiments, the system (100) comprises a light (160). In some embodiments, the light (160) is located on the sipper top (118) close to the slipper anterior end (112). In some embodiments, the light (160) is located on a light plane (170). In some embodiments, the light (160) projects a light beam on the light plane (170). In some embodiments, the light plane (170) is parallel to a slipper sole plane (120). In some embodiments, the light (160) is located in a light housing (162). In some embodiments, the light housing (162) is integrated into and contiguous with the slipper top (118). In some embodiments, the light (160) is positionably adjustable with respect to a first and a second direction of rotation. In some embodiments the light (160) is adjustable with respect to the light plane (170).

In some embodiments, the slipper (110) is located on the foot of the user. In some embodiments, the light (160) is activated via the power switch (150). In some embodiments, the light (160) projects the light beam in front of the user.

In some embodiments, the light (160) is a light emitting diode for cool operation and lighting quality. In some embodiments, the light emitting diode is colored. In some embodiments, the light (160) is an incandescent light bulb.

In some embodiments, a second light (165) is located beside the light (160). In some embodiments, the second light (165) is located on the slipper top (118) close to the slipper anterior end (112). In some embodiments, the second light (165) is located on the light plane (170). In some embodiments, the second light (165) projects a second light beam on the light plane (170). In some embodiments, the second light (165) is located in a second light housing (167). In some embodiments, the second light housing (167) is integrated into and contiguous with the slipper top (118). In some embodiments, the second light (165) is a duplicate of the light (160) with identical features.

In some embodiments, the power switch (150) is located on the slipper posterior end (114). In some embodiments, the power switch (150) is located on the slipper top (118) anterior to the light (160).

In some embodiments, the system (100) comprises a timer component (180). In some embodiments, timer is designed to shut off the light (160) after a time period to conserve power.

In some embodiments, the slipper (110) is water proof, being constructed of water proof material using water proof construction techniques. In some embodiments, the system (100) comprises a lighting kit that can be retrofitted onto a preexisting slipper or shoe. In some embodiments, the kit contains at least a power supply (130), a power switch (150), a light (160), a light housing (162), and wiring.

As used herein, the term "about" refers to plus or minus 10% of the referenced number.

The disclosures of the following U.S. Patents are incorporated in their entirety by reference herein: U.S. Pat. No. D 332,687; U.S. Patent Pub. No. 2011/0146109; U.S. Patent Pub. No. 2007/0144040; U.S. Patent Pub. No. 2002/0109981; U.S. Pat. No. 7,497,037; U.S. Pat. No. 6,293,032; U.S. Pat No. 5,821,858; U.S. Pat. No. 5,237,760; U.S. Pat. No. 4,324,054; and U.S. Pat. No. 3,564,232.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A path lighting system (100) integrated with a slipper (110) for wearing on a foot of a user, wherein the system (100) consists of:

(a) a slipper (110) having a slipper anterior end (112), a slipper posterior end (114), a slipper sole (116), a slipper side, and a slipper top (118), wherein the slipper top (118) proximal to the slipper anterior end (112) is designed to enclose a plurality of toes of a user, wherein the slipper sole (116) is disposed on a slipper sole plane (120);

(b) a power supply (130), wherein the power supply (130) is rechargeable, wherein the power supply (130) is disposed in the slipper sole (116) proximal to the slipper anterior end (112), wherein the power supply (130) is designed to be located close to a ball of a foot of the user, wherein a charging port (140) is disposed on a slipper sole side edge (117), wherein the charging port (140) is operatively connected to the power supply (130);

(c) a power switch (150) operatively connected to the power supply (130); and (d) a light (160), wherein the light (160) is disposed on the slipper top (118) and exterior to the slipper top (118) proximal to the slipper anterior end (112), wherein the light (160) is disposed on a light plane (170), wherein the light (160) projects a light beam on the light plane (170), wherein the light plane (170) is parallel to the slipper sole plane (120), wherein the light (160) is disposed in a light housing (162), wherein the light housing (162) is integrated into and contiguous with the slipper top (118);

wherein the slipper (110) is disposed on the foot of the user, wherein the light (160) is activated via the power switch (150), wherein the light (160) projects the light beam in front of the user, and (e) a timer component (180) operatively connected to the power switch (150), wherein timer is designed to shut off the light (160) after a time period to conserve power.

2. The system (100) of claim 1, wherein the light (160) is a light emitting diode.

3. The system (100) of claim 1, wherein a second light (165) is disposed beside the light (160), wherein the second light (165) is disposed on the slipper top (118) proximal to the slipper anterior end (112), wherein the second light (165) is disposed on the light plane (170), wherein the second light (165) projects a second light beam on the light plane (170), wherein the second light (165) is disposed in a second light housing (167), wherein the second light housing (167) is integrated into and contiguous with the slipper top (118).

4. The system (100) of claim 1, wherein the power switch (150) is disposed on the slipper posterior end (114).

5. The system (100) of claim 1, wherein the power switch (150) is disposed on the slipper top (118) anterior to the light (160).

* * * * *